US005727605A

United States Patent [19]

Ballu

[11] Patent Number: 5,727,605

[45] Date of Patent: Mar. 17, 1998

[54] DEVICE FOR FILLING THE RESERVOIR OF A SPRAY FOR PLANT-PROTECTION PRODUCTS

[75] Inventor: Patrick Ballu, Reims, France

[73] Assignee: Exel Industries, Epernay, France

[21] Appl. No.: 705,612

[22] Filed: Aug. 30, 1996

[30] Foreign Application Priority Data

Sep. 1, 1995 [FR] France ..... 95 10309

[51] Int. Cl.[6] ..... B65B 1/04

[52] U.S. Cl. ..... 141/20; 141/95; 141/198; 141/100; 137/614.2; 137/614.21

[58] Field of Search ..... 141/20, 2, 3, 18, 141/95, 198, DIG. 2, 192, 9, 100; 220/203.24, 203.26, 203.28; 222/402.16; 137/614.2, 614.21, 505.39

[56] References Cited

U.S. PATENT DOCUMENTS 2,053,931 9/1936 Work ..... 137/614.2

2,608,373 8/1952 Tuttle et al. ..... 249/60

4,630,642 12/1986 Detweiler ..... 137/614.2

4,953,593 9/1990 Edwards et al. ..... 137/614.2

*Primary Examiner*—J. Casimer Jacyna

*Assistant Examiner*—Steven O. Douglas

*Attorney, Agent, or Firm*—Jacobson, Price, Holman & Stern, PLLC

[57] ABSTRACT

A filling apparatus comprising a device (4) for connection to a source of water under pressure and a nonreturn valve (7) placed in fluid communication with the device (4) and mounted to allow passage from the source toward the reservoir (2), a calibrated valve (7) mounted between the nonreturn valve (7) and the reservoir (2) in the passage of water entering the reservoir (2), this valve (10) being sensitive to the pressure established in the reservoir (2) so as to cut off the water supply to the reservoir (2) when this pressure reaches a predetermined value.

12 Claims, 2 Drawing Sheets

Figure 1:
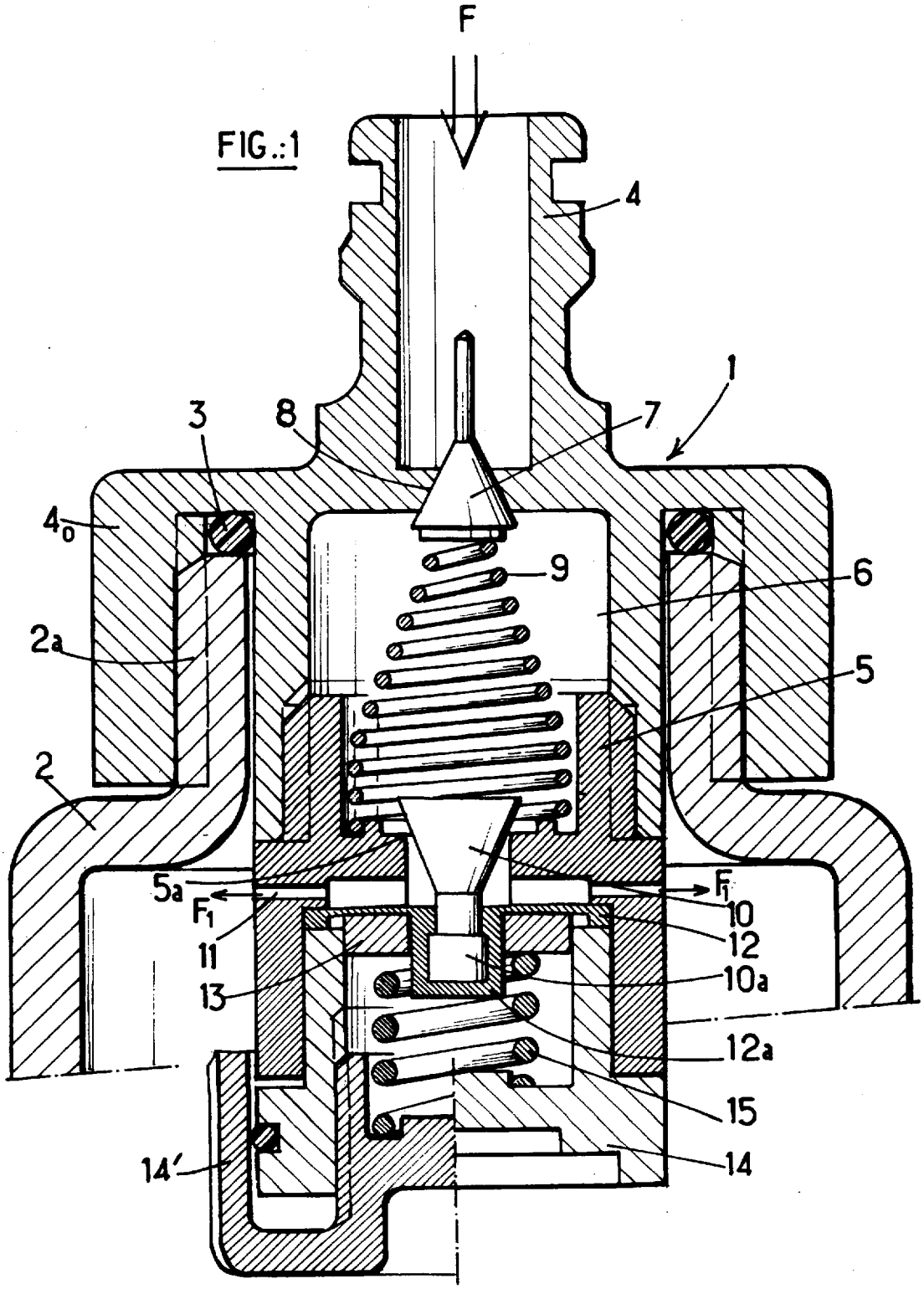

F
4
1
3
8
7
4o
9
6
2a
5
2
5a
F1
F1
10
11
12
13
10a
12a
15
14'
14

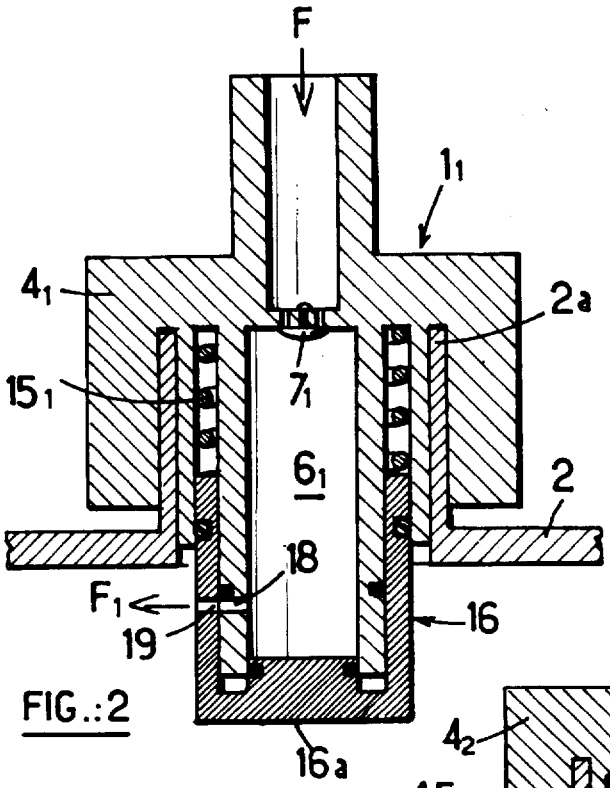
FIG.:2
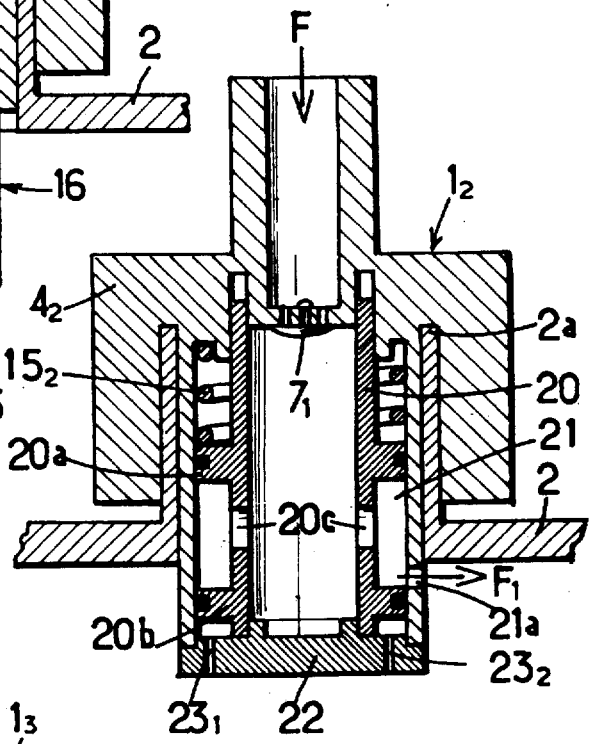
FIG.:3
FIG.:4
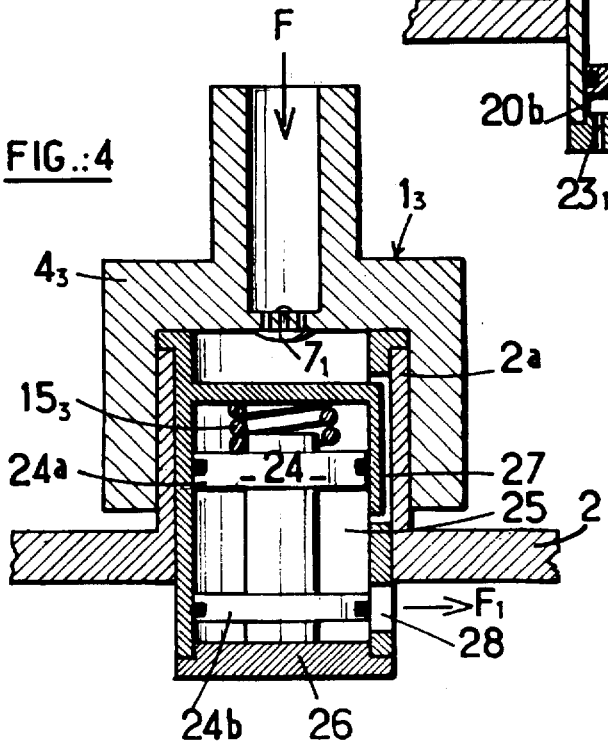

DEVICE FOR FILLING THE RESERVOIR OF A SPRAY FOR PLANT-PROTECTION PRODUCTS

The present invention relates to a device for filling the reservoir of a sprayer for plant-protection products in aqueous solution and, more specifically, to such a device comprising means for connecting the reservoir to a source of water under pressure and a nonreturn valve placed in these connecting means and mounted to allow passage from the source toward the reservoir.

A sprayer of this type, designed to be used by amateur or professional gardeners, is known. This sprayer conventionally comprises a sprayer lance fed by a reservoir under pressure containing an aqueous solution of a plant-protection product. When a dose of this product has been introduced into the reservoir, the latter is closed and connected to the water main, for example by means of a "quick" connector. Under the pressure of the mains water, the nonreturn valve opens and the reservoir fills until the air initially contained in the reservoir is compressed to a pressure which balances that of the mains water.

This device thus allows convenient filling of the reservoir while compressing the air trapped therein. Unfortunately, mains water pressure varies greatly, commonly from 2 to 10 bar. It will be appreciated that, in accordance with Boyle's law, the volume of the air compressed in the reservoir will therefore be a function of the pressure of the mains water. The result of this is that the volume of water contained in the reservoir varies with this pressure. This variation therefore disrupts the metering of the plant-protection product initially introduced, which may be very damaging as regards the effectiveness of the treatment of the plants in question.

Furthermore, if the mains water pressure is very much higher than the reference pressure anticipated for the reservoir, there is a risk that the latter will be brought up to an excessive pressure, which may be dangerous. After a certain spraying time, the pressure in the reservoir may drop down to an excessively low level and the user then has to actuate a hand pump conventionally incorporated into the sprayer in order to raise the pressure in the reservoir back up. As the sprayer of the type described hereinabove does not include the presence of a safety valve which opens with a hiss in the range of variation of the mains water pressure, the user, when actuating the pump, has no means to let him or her know that a sufficient pressure has been reestablished in the sprayer. He or she may continue to pump above and beyond that which is necessary, which is tiring and needless.

The object of the present invention is therefore to produce a device for filling the reservoir of a sprayer for plant-protection products with the water necessary for the formation of such a sprayer mixture, which ensures this filling with a constant volume of dilution water allowing accurate metering of the plant-protection product contained within the spraying mixture.

Another object of the present invention is to produce such a device which simultaneously pressurizes the reservoir.

Another object of the present invention is to produce such a device making it possible to establish, within the reservoir and before use, a pressure level which is high enough to be able to sprayer all the contents of the reservoir.

A further object of the present invention is to produce such a device which is reliable and avoids possible contamination by the overflowing of the spraying mixture during filling with water.

These objects of the invention, together with others which will become clear from reading the description which will follow are achieved using a device of the type described in the preamble of the present description, noteworthy in that it comprises a calibrated valve means mounted between the nonreturn valve and the reservoir, in the passage of water entering the reservoir, this valve being sensitive to the pressure in the reservoir so as to cut off the water supply to the reservoir when this pressure reaches a predetermined value.

By virtue of this calibrated valve, the amount of water introduced into the reservoir remains constant, irrespective of the pressure prevailing in the mains used to fill the reservoir. The dilution of the plant-protection product previously introduced into the reservoir can therefore be adjusted accurately.

Other features and advantages of the present invention will become clear from reading the description which will follow and from examining the attached drawing in which:

FIG. 1 is a view in axial section of a first embodiment of the device according to the invention, and FIGS. 2 to 4 are diagrammatic views in axial section of alternative forms of the device of FIG. 1.

Reference is made to FIG. 1 of the attached drawing, in which it is clear that the device represented comprises a body 1 designed to be fixed removably to the neck $\mathbf{2}_a$ of a container 2 by any known means, clipping, pinning or screwing, for example. By way of nonlimiting illustration, the body 1, which is axisymmetrical, may be designed to be screwed on to the neck of an orifice designed for the introduction of the dose of plant-protection product to be sprayed. The reservoir 2 is conventionally equipped with a piston-type pump used to pressurize the container and with a sprayer lance connected to the reservoir by a hose, these various conventional members not being represented in the drawing.

An O-ring 3 provides a seal for the mounting of the body 1 of the device on the neck $\mathbf{2}_a$. The body 1 includes an end piece 4 shaped so that it can be connected to a mains, by a "quick" connector for example, and a base $\mathbf{4}_o$ to which is fixed, coaxially, a component 5 which with this base defines a housing 6 for a nonreturn valve 7 loaded against its seat 8 by a spring 9 resting on the component 5.

According to the present invention, a calibrated valve 10 is mounted on this component 5, between the chamber 6 and the inside of the reservoir, holes 11 being pierced radially in this component to provide a fluid communication between the chamber 6 and the inside of the reservoir 2 when the valve 10 is moved away from its seat, as represented in FIG. 1.

The seat of the valve 10 consists of an axial drilling $\mathbf{5}_a$ formed in the component 5. The valve 10 has a stem $\mathbf{10}_a$ anchored in a central extension $\mathbf{12}_a$ of a membrane 12 made of an elastic material. This extension passes through a washer 13 closely attached to the membrane in order to pinch the stem of the valve. This washer can move axially in a cage 14 (represented in axial half section in FIG. 1) which is leakproof and fixed to the component 5 in order to contain a spring 15 loading the washer toward an axial position in which the valve 10 which it supports is away from its seat $\mathbf{5}_a$.

During the use of a sprayer equipped with the device according to the invention, first of all a dose of liquid or solid plant-protection product is introduced via an orifice in the reservoir of the spray. This may be a specialized orifice, or the one which removably receives the piston of the pump which conventionally equips a portable sprayer for plant-protection products. Next, the mains is connected to the reservoir via a hose fitted with a female quick connector, for example, coupling the latter to the male quick connector 4 of the device according to the invention. Of course, the position of this male quick connector and this female quick connector could be reversed. The mains water arriving in the direction of the arrow F pushes the nonreturn valve 7 away from its seat, enters the chamber 6, passes between the valve 10 and its seat $5_a$ on the component 5, and enters the reservoir via the radial holes 11, in the direction of the arrows $F_1$.

As the amount of water received by the reservoir increases, the pressure of the water and of the air trapped above the surface of the water increases. This pressure is transmitted, through the holes 11, to the face of the membrane 12 opposite to the one which receives the thrust from the spring 15. This thrust is adjusted or calibrated to keep the valve 10 open as long as the pressure in the reservoir has not reached a predetermined value. According to the invention, this predetermined value corresponds to a predetermined volume of water, or working volume, which sets the dilution ratio for the amount of plant-protection product previously introduced into the reservoir to an appropriate value. As the pressure acting on the membrane opposes the thrust from the spring, this increasing pressure ends up overcoming this thrust and causes the valve 10 to close onto its seat, for a predetermined air pressure value. Boyle's law fixes the volume of air thus achieved, and therefore the volume of water contained in the reservoir.

Sprayers are commonly equipped with a safety valve. The calibration of the valve 10 will therefore be set to a pressure value (2 bar for example) below that which causes the safety valve to open (namely around 3 bar).

Having filled the reservoir with a fixed volume of water, the water supply is disconnected and the air pressure in the reservoir may optionally be increased using the hand pump with which the sprayer is conventionally equipped. The number of piston strokes to be provided is obviously reduced through the initial pressurization established by the mains water, which proportionately lessens the work of the user. The safety valve, by hissing, alerts the user to the fact that the reference pressure has been reached. This pressure may be set to a value making it possible to empty the reservoir completely during the subsequent spraying action without having to actuate the hand pump again. This is an advantage scored over the device of the prior art described in the preamble of the present description, which does not allow the pressure reached at the end of filling or after a manual actuation of the pump to be fixed at predetermined values.

In the course of spraying, the pressure in the reservoir drops, which leads to a decompression of the spring 15 and, in time, to a relifting of the valve 10 which moves away from its seat. However, as the mains has been disconnected, the pressure in the reservoir which is then transmitted by the holes 11 and the valve 10 in the chamber 6 keeps, in interaction with the spring 9, the nonreturn valve 7 closed. The spraying mixture and the air trapped in the reservoir can therefore not escape to the outside through the nonreturn valve 7.

It will be further noted that the calibrated valve of the device according to the invention prevents any risk of overpressurizing the reservoir while filling with water, and this eliminates any risk of the reservoir exploding and makes it possible to comply with the national or international regulations which limit the value of the product of the volume of the reservoir times the maximum pressure which can prevail therein. The valve also prevents any overflowing of spraying mixture out of the reservoir, by means of a safety valve for example. One cause of environmental pollution is thus eliminated.

The device may be equipped with means making it possible to vary the amount of water let into the reservoir. For this, all that is required is for the calibration of the valve to be changed. This result is achieved simply with the aid of a screw-in limit stop 14' (represented in axial half section in FIG. 1) mounted in place of the bottom of the cage 14 in order to vary the compression of the spring 15. The limit stop is therefore graduated in terms of volume of water let in.

FIGS. 2 to 4 diagrammatically represent various alternative forms of the calibrated valve of the device of the present invention, mounted on bodies $1_1$, $1_2$, $1_3$ respectively, themselves fixed to the neck $2_a$ of the reservoir like the body 1 of the device of FIG. 1. Again, FIGS. 2 to 4 show a nonreturn valve $7_1$, which is slightly different from the one in FIG. 1, but conventional, as well as the arrows F and $F_1$ of this figure.

In FIG. 2, the calibrated valve assumes the form of a cylindrical cap 16 which slides on the wall of a chamber $6_1$, itself cylindrical, formed downstream of the nonreturn valve $7_1$ in the base $4_1$ of the body $1_1$. The cap 16 closes this chamber. Seals conventionally equip the interfaces between the cap and the base $4_1$. A spring $15_1$ normally keeps the cap in a position which causes the holes 18, 19 pierced respectively in the wall of the chamber $6_1$ and in the cap 16 in coincidence so that these holes establish fluid communication between the chamber $6_1$ and the inside of the reservoir 2. If the pressure exerted by the air on the head $16_a$ of the cap 16 exceeds a predetermined reference value, this pressure pushes the cap back toward the spring $15_1$ and the fluid communication 18, 19 is cut off.

In FIG. 3, the calibrated valve assumes the form of a hollow piston 20 sliding inside a chamber 21 formed in the base $4_2$ of the body $1_2$ of the device, downstream of the nonreturn valve $7_1$. An end piece 22 through which holes $23_1$, $23_2$ pass is fixed to the open end of this chamber. A spring $15_2$ loads the piston against the end piece 22. The piston 20 comprises two lands $20_a$, $20_b$ axially separated from one another and fitted, in the conventional way, with seals. Between these two lands the piston is pierced with holes $20_c$. The wall of the chamber 21 is pierced with a hole $21_a$. When the air pressure in the reservoir is below a predetermined value, the holes $20_c$, $21_a$ establish a fluid communication between downstream of the nonreturn valve $7_1$ and the reservoir. When the air pressure comes above this value, the piston 20 moves closer to the valve $7_1$ and the land $20_b$ closes the fluid communication $20_c$, $21_a$.

In FIG. 4, the calibrated valve also adopts the form of a piston 24 sliding inside a chamber 25 attached inside the base $4_3$ of the body $1_3$ of the device, downstream of the valve $7_1$. An end piece 26 closes the open end of the chamber 25. The piston 24 is solid and comprises two lands $24_a$, $24_b$ with seals, these lands being separated axially from one another. A passage 27 establishes a fluid communication between downstream of the nonreturn valve $7_1$ and a part of the chamber 25 situated between the two lands. A spring $15_3$ urges the piston 24 against the end piece 26. In this position the land $24_b$ frees a passage 28 in the wall of the chamber 25. Water entering in the direction of the arrow F into the body $1_3$ can therefore pass through the passages 27 and 28 to enter the reservoir 2. When the air pressure acting on the land $24_a$ of the piston 24 exceeds a predetermined reference value, the spring $15_3$ is compressed and the land $24_b$ closes off the chamber 25, cutting off the communication between the passages 27 and 28.

All the described embodiments of the invention may be manufactured so as to form an entity which can be mounted removably on the reservoir of the sprayer or, conversely, form an integral part of this reservoir.

It is now clear that both in the embodiment of FIG. 1 and in the alternative forms of FIGS. 2 to 4, the device according to the invention indeed allows the stated objectives to be achieved, namely that of filling the reservoir with an amount of water fixed in advance, allowing accurate adjustment of the concentration of a plant-protection product in this amount of water, while providing automatic pressurization of the reservoir and furthermore preventing an overpressure from being established in the reservoir during filling and therefore the possible damaging consequences of such an overpressure, particularly deterioration of the reservoir and overflowing of the spraying mixture out of the reservoir.

We claim:

1. A device for filling a reservoir of a sprayer for plant-protection products in aqueous solution, comprising means adapted for connecting the reservoir to a source of water under pressure and a nonreturn valve in fluid communication with said connecting means and mounted to define a passage from the source toward the reservoir, which device further comprises a calibrated valve means adapted to be mounted between the nonreturn valve and the reservoir in said passage, said calibrated valve means being sensitive to the pressure in the reservoir so as to cut off the water supply to the reservoir when this pressure reaches a predetermined value wherein said device is adapted to be attached to a reservoir of a sprayer.

2. The device as claimed in claim 1, wherein the calibrated valve means comprises a valve mounted on a membrane, one of the faces of the membrane being adapted to be in communication with the inside of the reservoir while the other face is isolated from this reservoir by a leakproof cage containing a spring urging the other face of the membrane so as to hold the valve away from its seat when the air pressure in the reservoir is below said predetermined value.

3. The device as claimed in claim 2, wherein said spring presses against a washer closely attached to the membrane, the calibrated valve means having a stem anchored in a central extension of the membrane which passes through the washer.

4. The device as claimed in claim 1, wherein the calibrated valve means assumes the form of a cylindrical cap sliding on the wall of a chamber of the device formed downstream of the nonreturn valve and closed by the cap, the cap being urged elastically by a spring into a position which establishes a fluid communication between said chamber and the inside of the reservoir when the pressure therein is below said predetermined value, said communication being closed off when the pressure is above said value.

5. The device as claimed in claim 1, wherein the calibrated valve means assumes the form of a sliding piston inside a chamber arranged downstream of the nonreturn valve, the piston defining a passage for the water between the nonreturn valve and the reservoir, the piston being loaded by a spring into a position in which the water flows from the piston passage into the reservoir through holes pieced in the piston and/or in the wall of the chamber, said piston moving away from said position when the pressure in the reservoir exceeds said predetermined value in order to cut off the fluid communication established by said holes.

6. Device as claimed in claim 5, wherein the piston is hollow and constitutes part of the fluid communication established between the nonreturn valve and the inside of the reservoir.

7. Device as claimed in claim 5, wherein the piston is solid and has two lands separated axially from one another, the space lying between the lands being placed in fluid communication with the downstream of the nonreturn valve, one of the lands cutting off any communication between said space and the inside of the reservoir when the pressure prevailing therein exceeds said predetermined value.

8. Device as claimed in claim 1, wherein the calibrated valve means is fitted with means for adjusting the calibration.

9. Device as claimed in claim 1, adapted to be mounted removably on the reservoir of a sprayer.

10. Device as claimed in claim 9, which is equipped with means for mounting on an orifice of the reservoir intended for the introduction of the plant-protection product.

11. Device as claimed in claim 1, is incorporated into a sprayer.

12. Device as claimed in claim 11, wherein the calibrated valve means is mounted in a base of a body integral with the reservoir.

* * * * *